US011413493B2

(12) United States Patent
Tsai et al.

(10) Patent No.: US 11,413,493 B2
(45) Date of Patent: Aug. 16, 2022

(54) TREADMILL HAVING AUXILIARY CUSHIONING

(71) Applicant: Advantek Health Tech Co., Ltd., Taichung (TW)

(72) Inventors: Chung-Hsien Tsai, Taichung (TW); Yung-Yi Chang, Taichung (TW)

(73) Assignee: Advantek Health Tech Co., Ltd., Taichung (TW)

( * ) Notice: Subject to any disclaimer, the term of this patent is extended or adjusted under 35 U.S.C. 154(b) by 0 days.

(21) Appl. No.: 17/141,639

(22) Filed: Jan. 5, 2021

(65) Prior Publication Data

US 2021/0260437 A1 Aug. 26, 2021

(30) Foreign Application Priority Data

Feb. 25, 2020 (TW) ..... 109202067

(51) Int. Cl.
*A63B 22/00* (2006.01)
*A63B 22/02* (2006.01)
(Continued)

(52) U.S. Cl.
CPC ..... *A63B 22/0012* (2013.01); *A63B 21/0083* (2013.01); *A63B 21/0087* (2013.01);
(Continued)

(58) Field of Classification Search
CPC ..... A63B 21/00; A63B 21/00047; A63B 21/00058; A63B 21/00061; A63B 21/00065; A63B 21/00069; A63B 21/00072; A63B 21/00076; A63B 21/00178; A63B 21/00181; A63B 21/00185; A63B 21/00189; A63B 21/00192; A63B 21/00196; A63B 21/002; A63B 21/0023; A63B 21/005; A63B 21/0051; A63B 21/0052; A63B 21/0053; A63B 21/0056; A63B 21/0057;
(Continued)

(56) References Cited

U.S. PATENT DOCUMENTS 4,635,928 A * 1/1987 Ogden ..... A63B 22/0257 482/54
5,000,440 A * 3/1991 Lynch ..... A63B 22/0012 482/130

(Continued)

*Primary Examiner* — Megan Anderson
*Assistant Examiner* — Thao N Do
(74) *Attorney, Agent, or Firm* — Karin L. Williams; Alan D. Kamrath; Mayer & Williams PC

(57) ABSTRACT

A treadmill contains a body, a support assembly, a resistance unit, and a stop strap. The body includes a holder and a circular running belt. The support assembly includes multiple posts and two columns, wherein each column having a slidable space, and the slidable space having two first chutes. A resistance unit includes two sliding devices, two limitation structures, and a force exerting element. The respective sliding device has a slider and multiple first rollers. The respective limitation structure includes two cylinder units, a resilient unit, a first fixing unit, and a second fixing unit. The force exerting element has two connection rods connected on two ends thereof, and the respective connection rod of the force exerting element is coupled with the coupling portion of the slider of the respective sliding device.

16 Claims, 12 Drawing Sheets

(51) Int. Cl.
*A63B 21/00* (2006.01)
*A63B 21/008* (2006.01)
*A63B 22/20* (2006.01)

(52) U.S. Cl.
CPC ..... *A63B 21/4035* (2015.10); *A63B 22/0005* (2015.10); *A63B 22/0046* (2013.01); *A63B 22/02* (2013.01); *A63B 22/203* (2013.01)

(58) Field of Classification Search
CPC ..... A63B 21/0058; A63B 21/008; A63B 21/0083; A63B 21/0084; A63B 21/00845; A63B 21/0085; A63B 21/0087; A63B 21/012; A63B 21/0125; A63B 21/015; A63B 21/018; A63B 21/02; A63B 21/04; A63B 21/045; A63B 21/0455; A63B 21/05; A63B 21/055; A63B 21/0552; A63B 21/0555; A63B 21/0557; A63B 21/06; A63B 21/065; A63B 21/068; A63B 21/078; A63B 21/08; A63B 21/15; A63B 21/151; A63B 21/152; A63B 21/154; A63B 21/155; A63B 21/156; A63B 21/157; A63B 21/158; A63B 21/159; A63B 21/16; A63B 21/22; A63B 21/222; A63B 21/28; A63B 21/285; A63B 21/40; A63B 21/4001; A63B 21/4011; A63B 21/4013; A63B 21/4015; A63B 21/4023; A63B 21/4025; A63B 21/4029; A63B 21/4031; A63B 21/4033; A63B 21/4034; A63B 21/4035; A63B 21/4041; A63B 21/4043; A63B 21/4045; A63B 21/4047; A63B 21/4049; A63B 22/00; A63B 22/0002; A63B 22/0005; A63B 22/0007; A63B 22/001; A63B 22/0012; A63B 22/0015; A63B 22/0017; A63B 22/0023; A63B 22/0025; A63B 22/0046; A63B 22/0048; A63B 22/0056; A63B 22/0058; A63B 22/0061; A63B 22/0064; A63B 22/0066; A63B 22/0069; A63B 22/02; A63B 22/0207; A63B 22/0214; A63B 22/0221; A63B 22/0228; A63B 22/0235; A63B 22/0242; A63B 22/025; A63B 22/0257; A63B 22/0264; A63B 22/0285; A63B 22/0292; A63B 22/04; A63B 22/20; A63B 22/201; A63B 22/203; A63B 22/205; A63B 22/208; A63B 23/00; A63B 23/02; A63B 23/0205; A63B 23/0211; A63B 23/0216; A63B 23/0222; A63B 23/0227; A63B 23/0233; A63B 23/0244; A63B 23/035; A63B 23/03508; A63B 23/03516; A63B 23/03525; A63B 23/03533; A63B 23/03541; A63B 23/0355; A63B 23/04; A63B 23/0405; A63B 23/0458; A63B 23/0464; A63B 23/08; A63B 23/085; A63B 23/10; A63B 2069/0031; A63B 2069/0033; A63B 69/00; A63B 69/0028; A63B 2208/00; A63B 2208/02; A63B 2208/0204; A63B 2208/0209; A63B 2208/0214; A63B 2220/00; A63B 2220/10; A63B 2220/16; A63B 2220/18; A63B 2220/20; A63B 2220/22; A63B 2220/24; A63B 2220/30; A63B 2220/31; A63B 2220/34; A63B 2220/35; A63B 2220/36; A63B 2220/40; A63B 2220/44; A63B 2220/50; A63B 2220/51; A63B 2220/52; A63B 2220/56; A63B 2220/58
USPC ..... 482/54
See application file for complete search history.

(56) References Cited

U.S. PATENT DOCUMENTS 5,176,597 A * 1/1993 Bryne ..... A61H 3/008 482/54
6,835,166 B1 * 12/2004 Stearns ..... A63B 22/208 482/52
7,878,950 B1 * 2/2011 Bastian ..... A63B 21/4035 482/54
9,907,994 B1 * 3/2018 Maresh ..... A63B 21/00181
2008/0161163 A1 * 7/2008 Stewart ..... A63B 21/0051 482/51
2008/0161164 A1 * 7/2008 Stewart ..... A63B 22/0017 482/52
2010/0113227 A1 * 5/2010 Habing ..... A63B 22/0005 482/51
2011/0039662 A1 * 2/2011 Gordon ..... A63B 22/0292 482/52
2011/0082013 A1 * 4/2011 Bastian ..... A63B 21/4035 482/54
2013/0123073 A1 * 5/2013 Olson ..... A63B 22/02 482/54
2013/0190140 A1 * 7/2013 Chen ..... A63B 22/0292 482/54
2014/0213951 A1 * 7/2014 Pietrusisnki ..... A61H 3/008 602/23
2014/0274576 A1 * 9/2014 Beard ..... A63B 24/0087 482/54
2014/0274577 A1 * 9/2014 Beard ..... A63B 24/0087 482/54
2015/0080187 A1 * 3/2015 Beane ..... A63B 69/0064 482/51
2016/0023039 A1 * 1/2016 Cei ..... A63B 22/0285 482/54
2016/0023045 A1 * 1/2016 Dalebout ..... A63B 24/0087 482/8
2016/0023049 A1 * 1/2016 Dalebout ..... A63B 22/0242 482/7
2016/0059078 A1 * 3/2016 Liao ..... A63B 24/0087 482/4
2016/0166877 A1 * 6/2016 Cei ..... A63B 22/0285 482/54
2016/0346598 A1 * 12/2016 Manzke ..... A63B 22/02
2017/0128769 A1 * 5/2017 Long ..... A63B 22/02
2017/0136289 A1 * 5/2017 Frank ..... A63B 69/0057
2017/0136290 A1 * 5/2017 Cei ..... A63B 24/0087
2017/0225023 A1 * 8/2017 Crist ..... A63B 21/0414
2017/0326407 A1 * 11/2017 Johnson ..... A63B 22/0046
2018/0043206 A1 * 2/2018 Crist ..... A63B 21/00069
2018/0140896 A1 * 5/2018 Chen ..... A63B 21/4035
2018/0214736 A1 * 8/2018 Ota ..... A63B 22/0235
2019/0083844 A1 * 3/2019 Bayerlein ..... A63B 69/0057
2019/0105531 A1 * 4/2019 Wu ..... A63B 21/015
2019/0160327 A1 * 5/2019 Wilson ..... A63B 1/005
2019/0217142 A1 * 7/2019 Hsu ..... A63B 22/02
2019/0321680 A1 * 10/2019 Manzke ..... A63B 21/00069
2019/0366149 A1 * 12/2019 Crist ..... A63B 21/0552
2019/0374811 A1 * 12/2019 Bayerlein ..... A63B 22/02
2020/0268308 A1 * 8/2020 Sankai ..... A61H 3/00
2020/0376329 A1 * 12/2020 Liao ..... A63B 21/00192
2021/0113413 A1 * 4/2021 Pomeroy ..... A61H 1/0237
2021/0170222 A1 * 6/2021 Consiglio ..... A63B 22/025

* cited by examiner

TREADMILL HAVING AUXILIARY CUSHIONING

BACKGROUND OF THE INVENTION

Field of the Invention

The present invention relates to exercise equipment, and more particularly to a treadmill having auxiliary cushioning.

Description of the Prior Art

A conventional treadmill is exercise equipment with simple operation and high exercise efficiency. It is used for aerobic exercise (such as walking or running) and is not affected by an external environment and climate, and it can be used in indoor exercises with limited space. Except for some families who buy the treadmill and use it at home, the treadmill may be used in a gym of a hotel and fitness centers.

However, although a conventional treadmill has a fitness function of walking or running, and can provide users with training functions such as foot muscle strength and cardiopulmonary training, it cannot be used for training in other ways. Therefore, the function is limited and the use of the treadmill becomes boring. In addition, the conventional treadmill is not suitable for fast running or full sprinting, because if the user's running speed continues to increase, a forward speed corresponding to a running action may be faster than a backwards sliding speed of a surface of a running belt. In other words, the user will approach a front end of the running platform, and in order to maintain in a proper area of the running belt, the user will naturally restrain his running speed, which will result in a failure of maximum ability, and it is impossible to meet expected training effect.

The present invention has arisen to mitigate and/or obviate the afore-described disadvantages.

SUMMARY OF THE INVENTION

The primary object of the present invention is to provide a treadmill which contains a force exerting element configured to be held by a user to enhance running safety and stability, wherein the force exerting element slides when a push force of the force exerting element is more than a resistance of the force exerting element, so that when a user runs on the treadmill, the user also exercises his/her hands and trains core muscles, thus increasing the function of the treadmill.

Another object of the present invention is to provide a treadmill which contains a force exerting element configured to be held by the user and to be pushed forward, such that the user is limited to run on a predetermined position of the treadmill and have simulative weight training by pushing a heavy object to move forward.

To obtain above-mentioned aspect, a treadmill provided by the present invention contains: a body, a support assembly, a resistance unit, and a stop strap.

The body includes a holder and a circular running belt rotatably surrounding around the holder.

The support assembly is connected on the holder of the body, and the support assembly includes multiple posts and two columns, the multiple posts extend upward from two sides of the body, the two columns is connected on the multiple posts of the two sides of the body so that the two columns are parallelly mounted above the two sides of the body. The respective column has a slidable space defined therein, and the slidable space has two first chutes defined on two sides thereof.

The resistance unit is fixed on the support assembly, and the resistance unit includes two sliding devices, two limitation structures, and a force exerting element.

The respective sliding device has a slider, multiple first rollers rotatably connected on two sides of the slider. The slider of the respective sliding device is slidably accommodated in the slidable space of the respective column of the support assembly, the respective first roller of the slider is slidably received in the respective first chute of the slidable space, such that the slider of the respective sliding device slides linearly in the slidable space. The respective sliding device further has a coupling portion extending out of the slidable space from the slider downward.

The respective limitation structure is accommodated in the slidable space of the respective column of the support assembly and is connected with the slider of the respective sliding device so that the slider of the respective sliding device is stopped and limited in the slidable space, when sliding. The respective limitation structure includes two cylinder units, a resilient unit, a first fixing unit, and a second fixing unit. The respective cylinder unit and the first fixing unit of the respective limitation structure are disposed on a front end of the slider of the respective sliding device, and the first fixing unit is mounted on a front end of the respective cylinder unit. A first end of the respective cylinder unit of the respective limitation structure is connected with the slider of the respective sliding device, and a second end of the respective cylinder unit of the respective limitation structure is connected with the first fixing unit. The resilient unit and the second fixing unit of the respective limitation structure are fixed on a rear end of the slider of the respective sliding device, and the second fixing unit is secured on a rear end of the resilient unit. A first end of the resilient unit of the respective limitation structure is connected with the slider of the respective sliding device, and a second end of the resilient unit of the respective limitation structure is connected with the second fixing unit.

The force exerting element has two connection rods connected on two ends thereof, and the respective connection rod of the force exerting element is coupled with the coupling portion of the slider of the respective sliding device, such that a grip portion of the force exerting element is defined between the two columns of the support assembly, and the force exerting element actuates the slider of the respective sliding device to move.

DETAILED DESCRIPTION OF THE PREFERRED EMBODIMENTS

Figure 1:
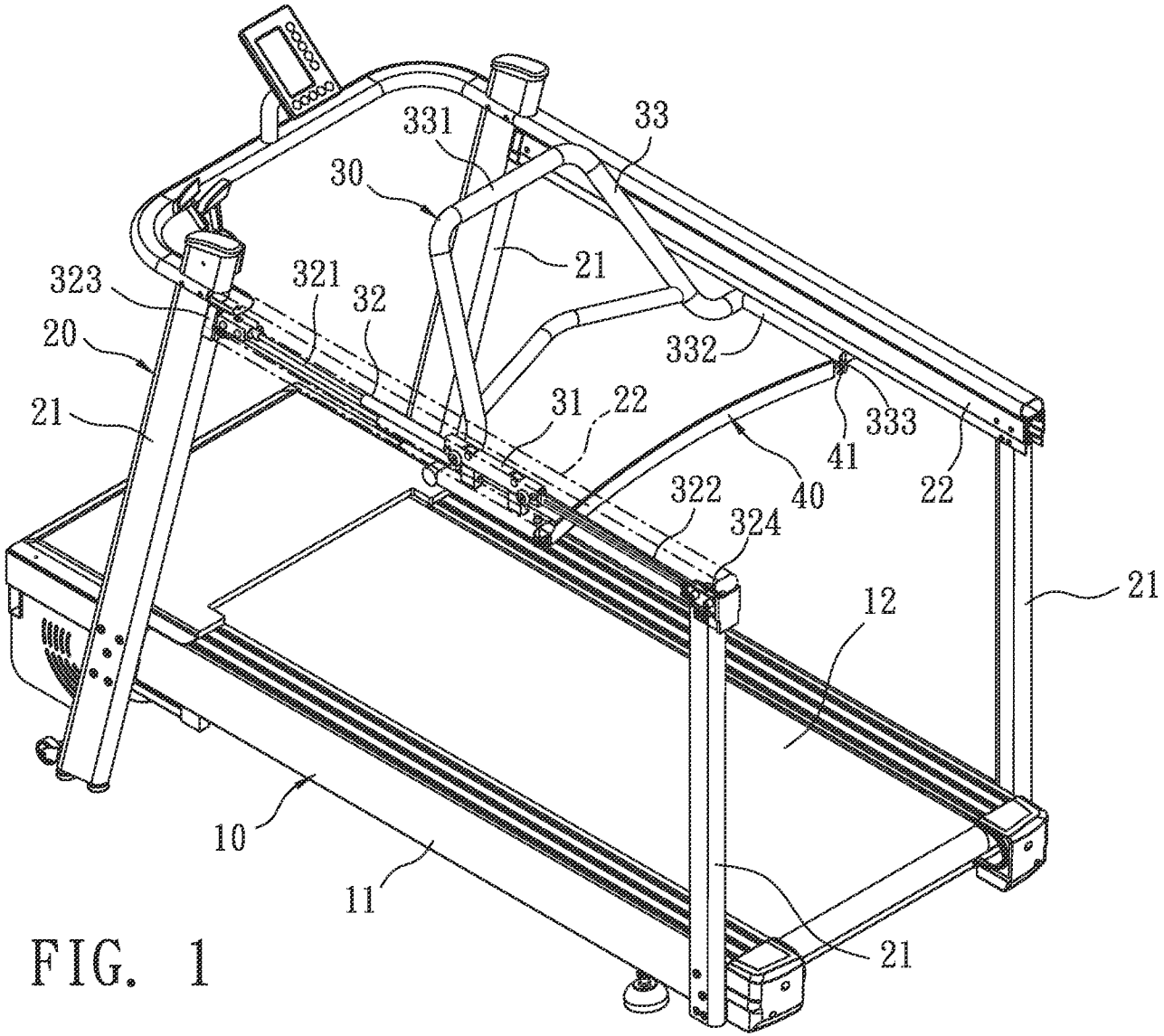
FIG. 1 is a perspective view showing the assembly of a part of a treadmill according to a first embodiment of the present invention.
Figure 2:
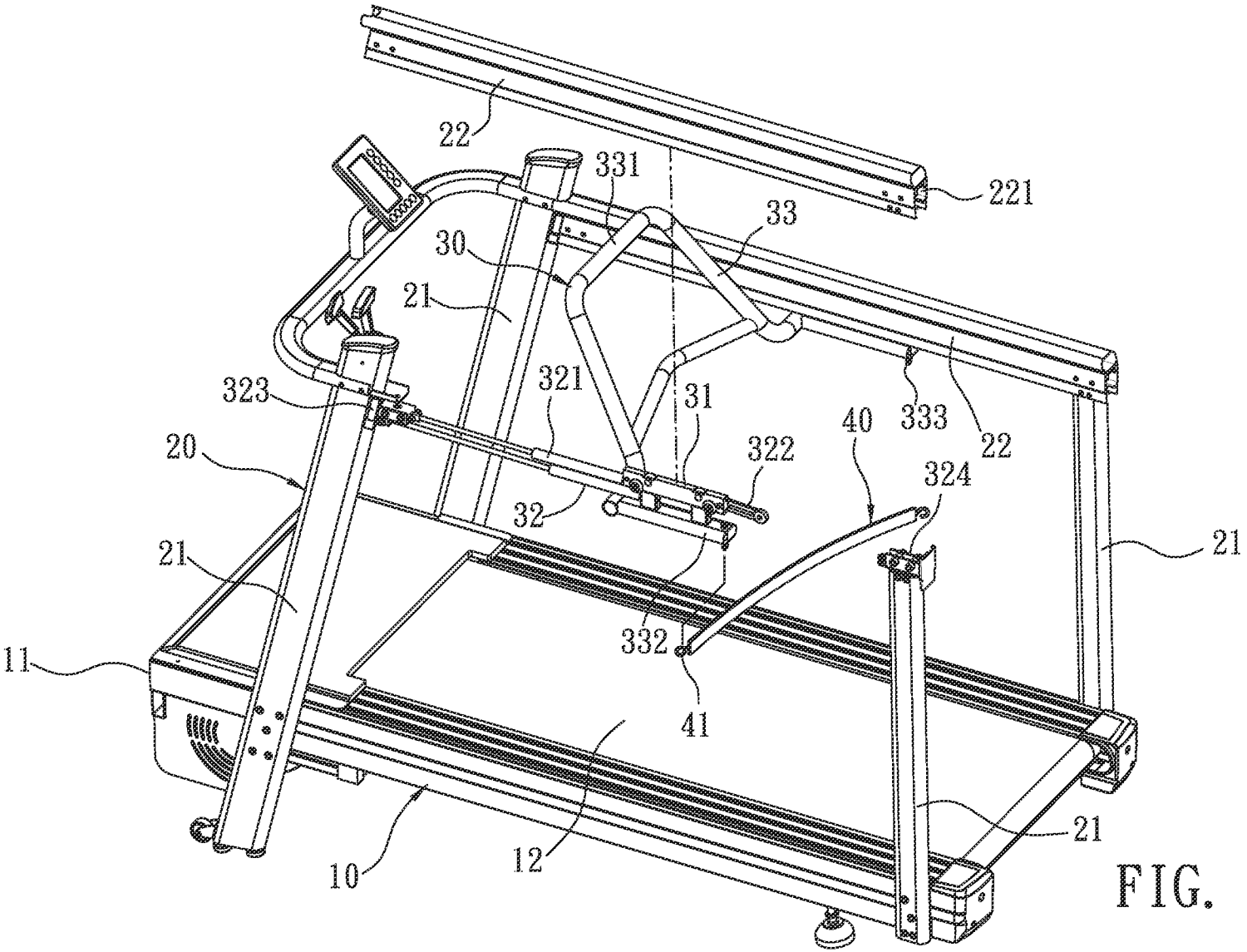
FIG. 2 is a perspective view showing the exploded components of the treadmill according to the first embodiment of the present invention.
Figure 3:
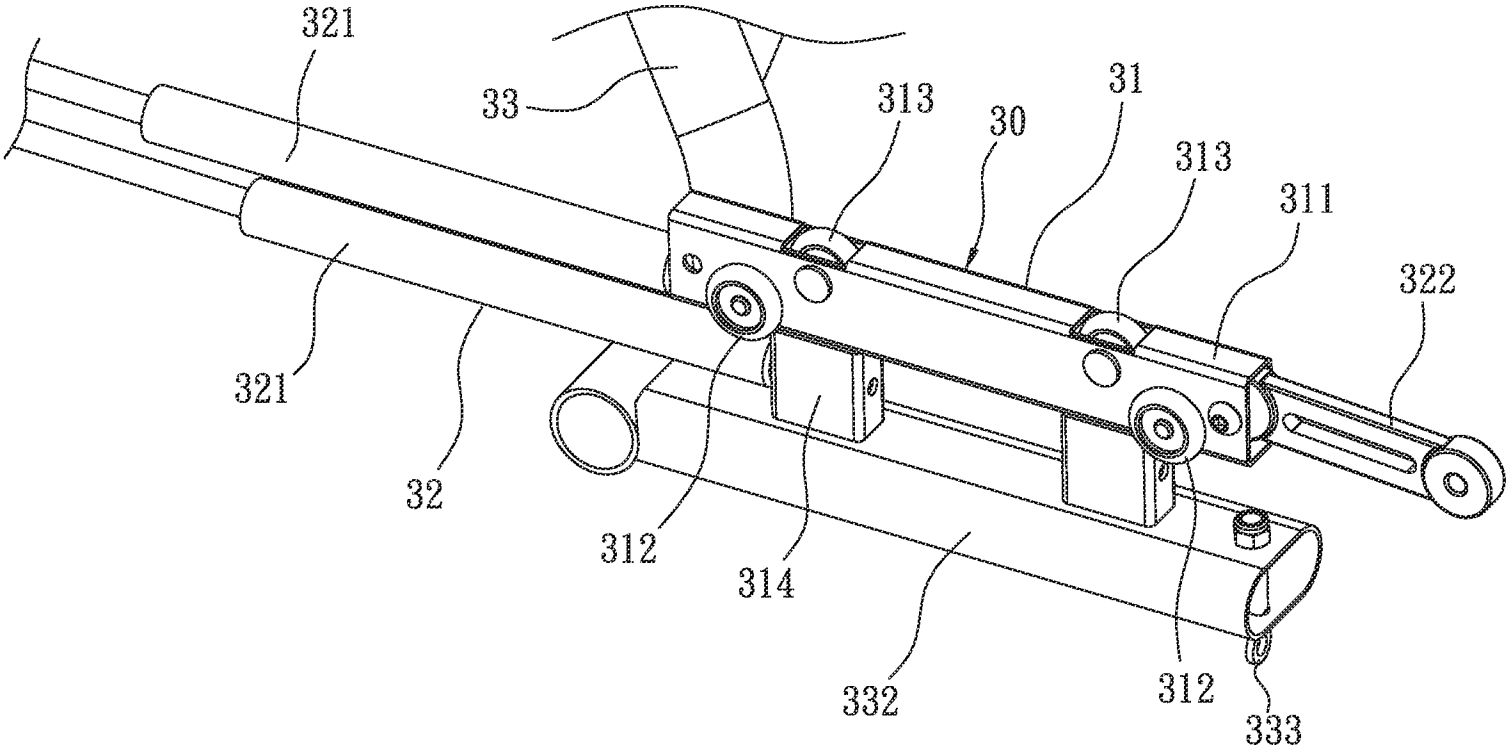
FIG. 3 is a perspective view showing the assembly of a resistance unit of the treadmill according to the first embodiment of the present invention.
Figure 4:
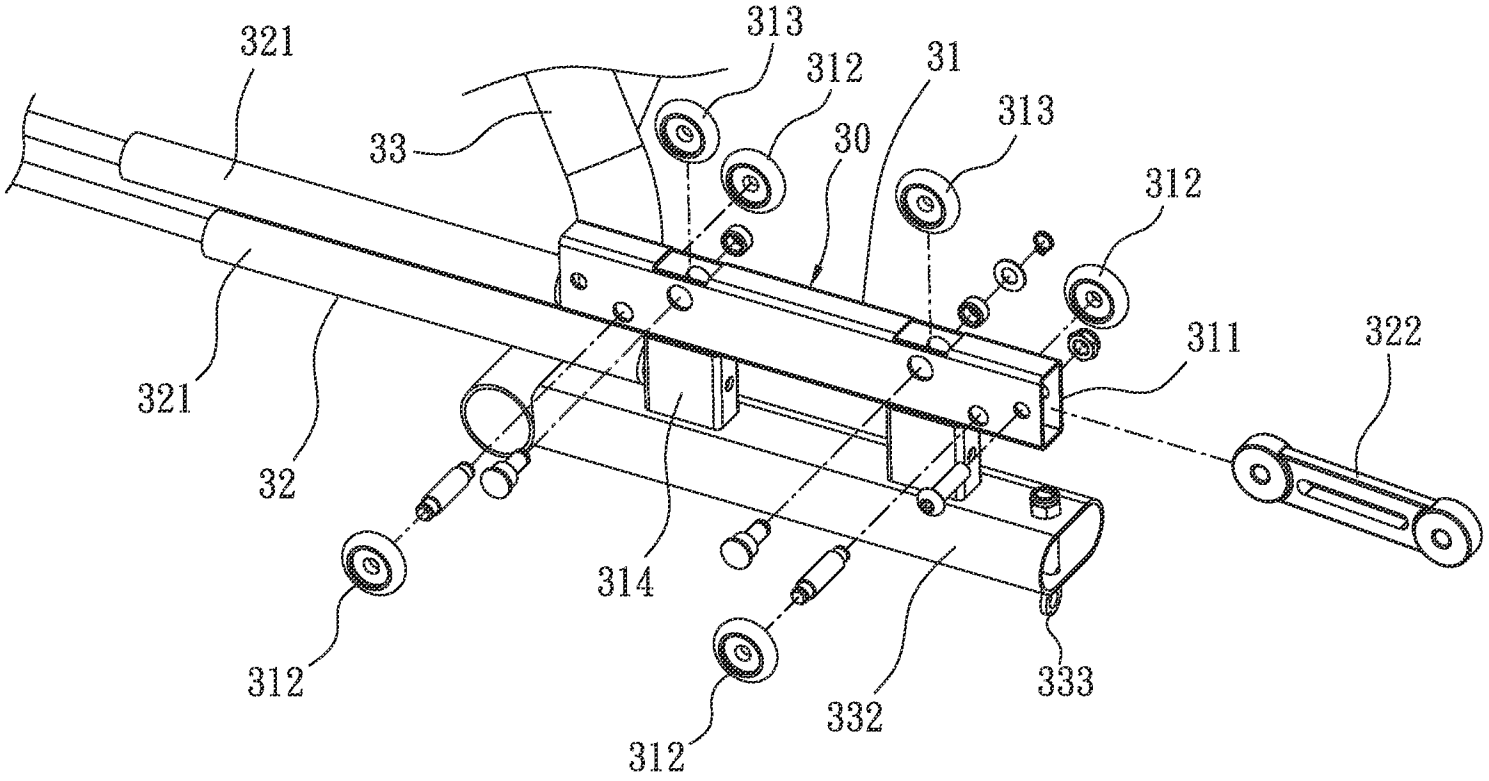
FIG. 4 is a perspective view showing the exploded components of the resistance unit of the treadmill according to the first embodiment of the present invention.
Figure 5:
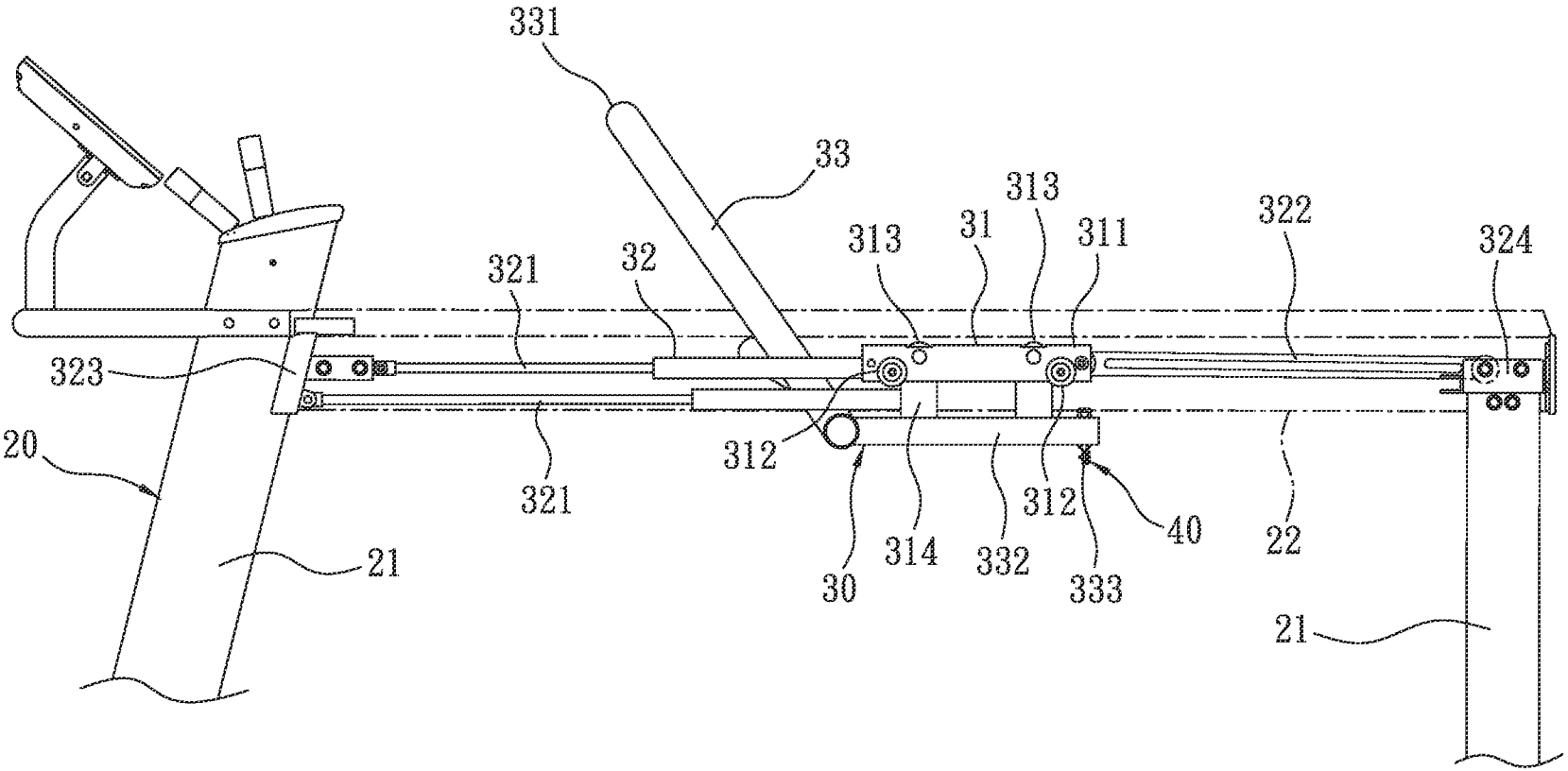
FIG. 5 is a side plan view showing the assembly of the treadmill according to the first embodiment of the present invention.
Figure 6:
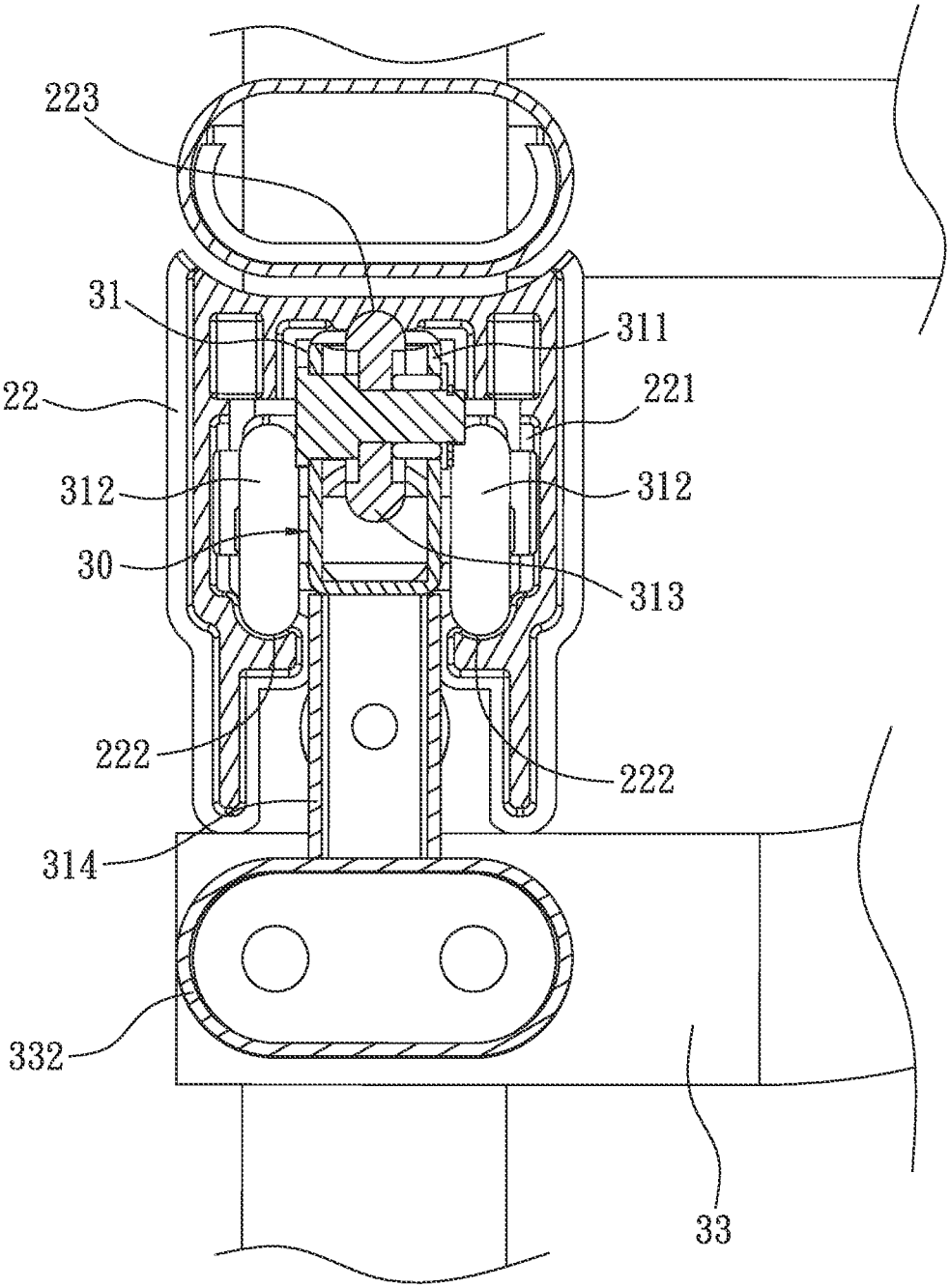
FIG. 6 is a cross sectional view showing the assembly of a part of the treadmill according to the first embodiment of the present invention.

The present invention will be clearer from the following description when viewed together with the accompanying drawings, which show, for purpose of illustrations only, a preferred embodiment in accordance with the present invention.

With reference to FIGS. 1-6, a treadmill having auxiliary cushioning according to a first embodiment of the present invention comprises: a body 10, a support assembly 20, a resistance unit 30, and a stop strap 40.

The body 10 includes a holder 11 and a circular running belt 12 rotatably surrounding around the holder 11, wherein the body 10 is unpowered or is driven electrically by a motor.

The support assembly 20 is connected on the holder 11 of the body 10, and the support assembly 20 includes multiple posts 21 and two columns 22, the multiple posts 21 extend upward from two sides of the body 10, the two columns 22 are connected on the multiple posts 21 of the two sides of the body 10 so that the two columns 22 are parallelly mounted above the two sides of the body 10, wherein the respective column 22 has a slidable space 221 defined therein, the slidable space 221 has two first chutes 222 defined on two sides thereof, and the slidable space 221 has a second chute 223 formed on a top thereof.

The resistance unit 30 is fixed on the support assembly 20, and the resistance unit 30 includes two sliding devices 31, two limitation structures 32, and a force exerting element 33.

The respective sliding device 31 has a slider 311, multiple first rollers 312 rotatably connected on two sides of the slider 311 (in this embodiment, the two sides of the slider 311 are rotatably connected with two first rollers 312), and at least one second roller 313 rotatably connected with a top of the slider 311 (in this embodiment, two second rollers 313 are rotatably connected with the top of the slider 311), wherein the slider 311 of the respective sliding device 31 is slidably accommodated in the slidable space 221 of the respective column 22 of the support assembly 20, the respective first roller 312 of the slider 311 is slidably received in the respective first chute 222 of the slidable space 221, and the respective second roller 313 of the slider 311 is slidably received in the second chute 223 of the slidable space 221, such that the slider 311 of the respective sliding device 31 slides linearly in the slidable space 221, wherein the respective sliding device 31 further has a coupling portion 314 extending out of the slidable space 221 from the slider 311 downward.

The respective limitation structure 32 is accommodated in the slidable space 221 of the respective column 22 of the support assembly 20 and is connected with the slider 311 of the respective sliding device 31 so that the slider 311 of the respective sliding device 31 is stopped and limited in the slidable space 221, when sliding. In this embodiment, the respective limitation structure 32 includes two cylinder units 321, a resilient unit 322, a first fixing unit 323, and a second fixing unit 324, wherein the respective cylinder unit 321 is a pneumatic cylinder or a hydraulic cylinder, and the resilient unit 322 is a resilient band. The respective cylinder unit 321 and the first fixing unit 323 of the respective limitation structure 32 are disposed on a front end of the slider 311 of the respective sliding device 31, the first fixing unit 323 is mounted on a front end of the respective cylinder unit 321, wherein a first end of the respective cylinder unit 321 of the respective limitation structure 32 is connected with the slider 311 of the respective sliding device 31, and a second end of the respective cylinder unit 321 of the respective limitation structure 32 is connected with the first fixing unit 323. The resilient unit 322 and the second fixing unit 324 of the respective limitation structure 32 are fixed on a rear end of the slider 311 of the respective sliding device 31, the second fixing unit 324 is secured on a rear end of the resilient unit 322, wherein a first end of the resilient unit 322 of the respective limitation structure 32 is connected with the slider 311 of the respective sliding device 31, and a second end of the resilient unit 322 of the respective limitation structure 32 is connected with the second fixing unit 324.

The force exerting element 33 has a grip portion 331 formed on a middle section thereof so as to be held by a user, two connection rods 332 connected on two ends of the force exerting element 33, and two retainers 333 connected with the two connection rods 332 of the force exerting element 33, wherein the respective connection rod 332 of the force exerting element 33 is coupled with the coupling portion 314 of the slider 311 of the respective sliding device 31, such that the grip portion 331 of the force exerting element 33 is defined between the two columns 22 of the support assembly 20, and the force exerting element 33 actuates the slider 311 of the respective sliding device 31 to move.

The stop strap 40 includes two hook portions 41 formed on two ends thereof, wherein the respective hook portion 41 of the stop strap 40 is hooked with the respective retainer 333 of the respective connection rod 332 of the force exerting element 33, such that the stop strap 40 is horizontally fixed between the two connection rods 332 of the force exerting element 33.

Figure 7:
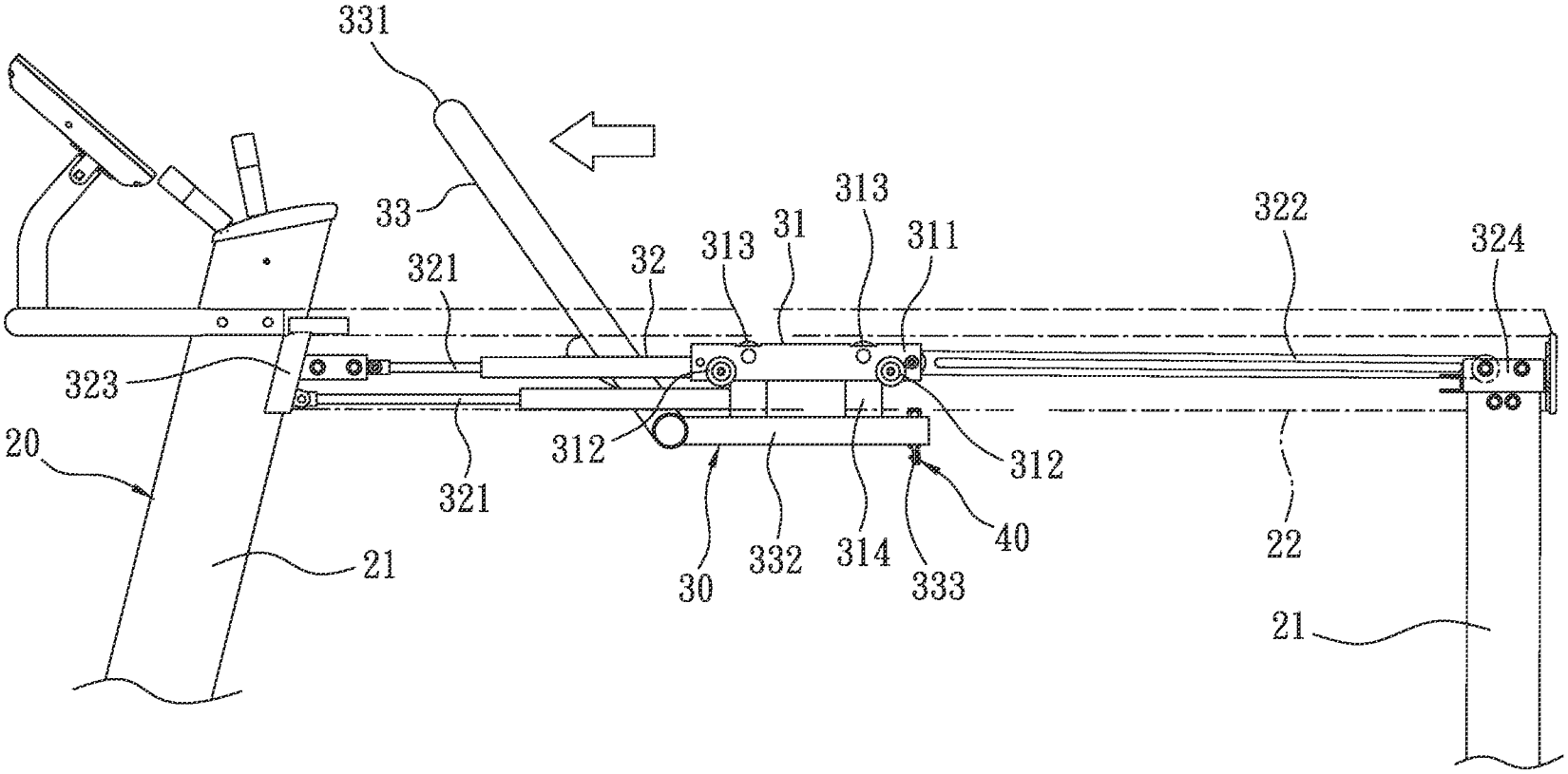
FIG. 7 is a side plan view showing the operation of a force exerting element of the treadmill according to the first embodiment of the present invention.

When the user runs on the circular running belt 12 of the body 10, the grip portion 331 of the force exerting element 33 is held by the user so as to run on the body 10 stably, and the force exerting element 33 is pushed forward by the user to actuate the slider 311 of the respective sliding device 31 to slide forward in the slidable space 221 (as shown in FIG. 7), the respective cylinder unit 321 and the resilient unit 322 of the respective limitation structure 32 stop the force exerting element 33 and the slider 311 of the respective sliding device 31 sliding forward, thus running on a predetermined position of the body 10. In addition, the user exercises hands, for example, the user pushes a heavy object forward on the body 10 to train core muscles.

When the user holds the grip portion 331 of the force exerting element 33, the force exerting element 33 moves back to an original position by way of the respective cylinder unit 321 and the resilient unit 322 of the respective limitation structure 32, thus avoiding a damage of the force exerting element 33 to the user.

When the user runs on the circular running belt 12 of the body 10, the stop strap 40 stops a waist of the user and is pushed by the user to move forward, the force exerting element 33 actuates the slider 311 of the respective sliding device 31 to slide forward in the slidable space 221, and the respective cylinder unit 321 and the resilient unit 322 of the respective limitation structure 32 move so that the stop strap 40 and the slider 311 of the respective sliding device 31 stop and limit the user moving forward, such that the user runs and has a weight training on the body 10.

Figure 8:
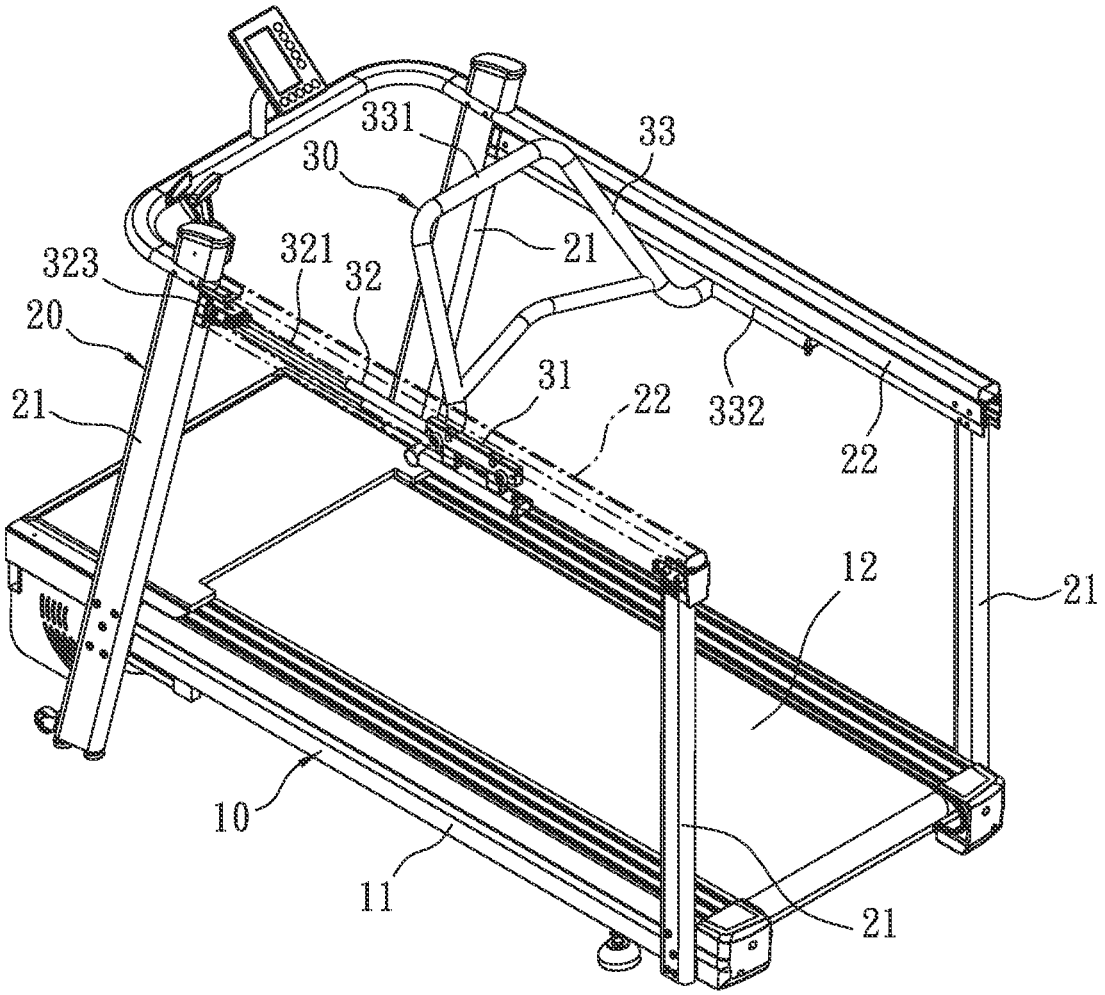
FIG. 8 is a perspective view showing the assembly of a part of a treadmill according to a second embodiment of the present invention.
Figure 9:
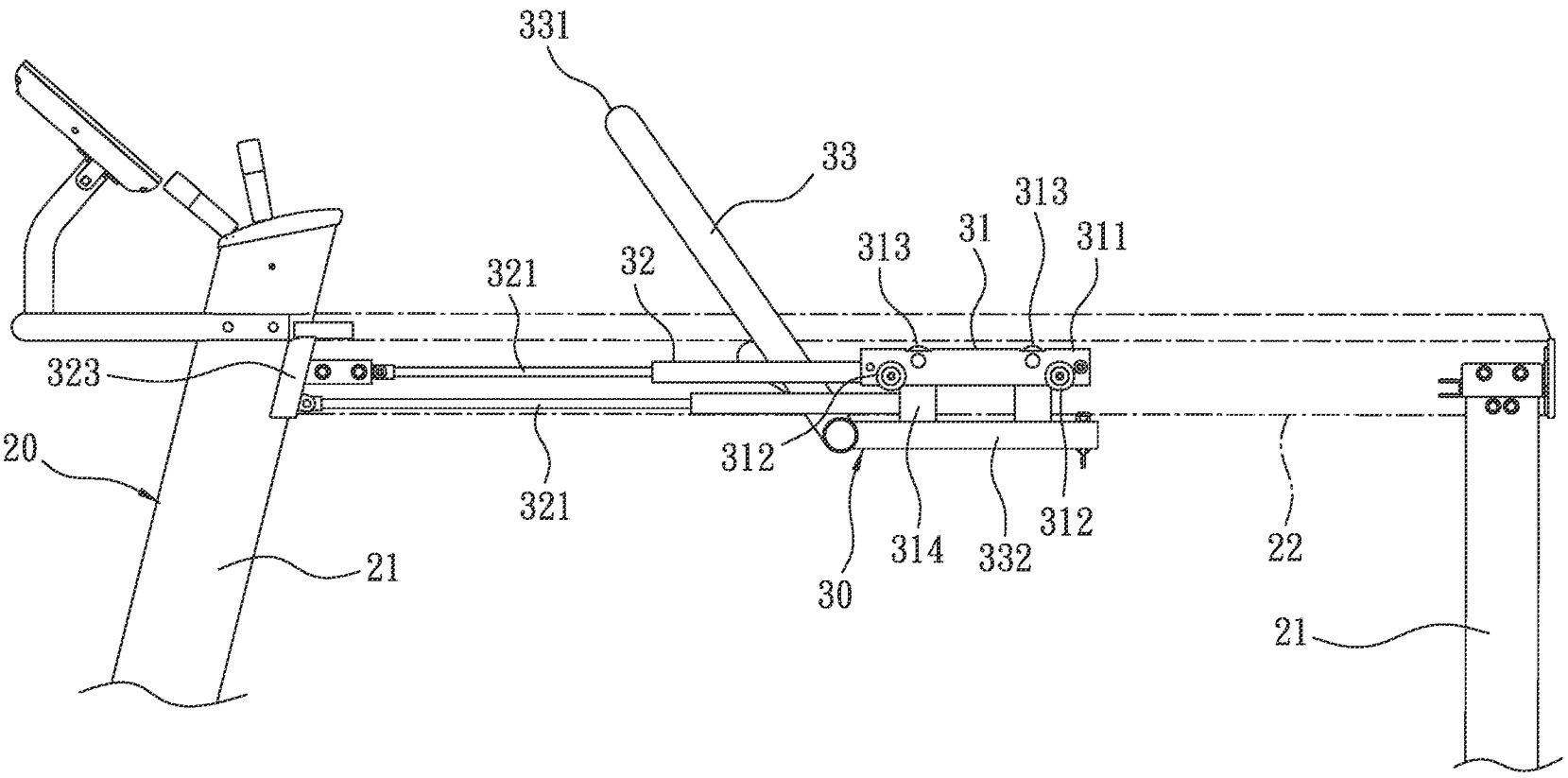
FIG. 9 is a side plan view showing the assembly of the treadmill according to the second embodiment of the present invention.

Referring to FIGS. 8 and 9, a difference of a treadmill of a second embodiment from that of the first embodiment includes one of two limitation structures 32 including two cylinder units 321 and a first fixing unit 323, wherein the respective cylinder unit 321 is a pneumatic cylinder or a hydraulic cylinder, the respective cylinder unit 321 and the first fixing unit 323 of the respective limitation structure 32 are fixed on the front end of the slider 311 of the respective sliding device 31, and the first fixing unit 32 is disposed on a front end of the respective cylinder unit 321, wherein a first end of the respective cylinder unit 321 of the respective limitation structure 32 is connected with the slider 311 of the respective sliding device 31, and a second end of the respective cylinder unit 321 of the respective limitation structure 32 is connected with the first fixing unit 323.

When the user runs on the circular running belt 12 of the body 10, the grip portion 331 of the force exerting element 33 is held by the user so as to run on the body 10 stably, and the force exerting element 33 is pushed forward by the user to actuate the slider 311 of the respective sliding device 31 to slide forward in the slidable space 221, the respective cylinder unit 321 of the respective limitation structure 32 stops the force exerting element 33 and the slider 311 of the respective sliding device 31 sliding forward, thus running on a predetermined position of the body 10. In addition, the user exercises hands, for example, the user pushes a heavy object forward on the body to train core muscles.

Figure 10:
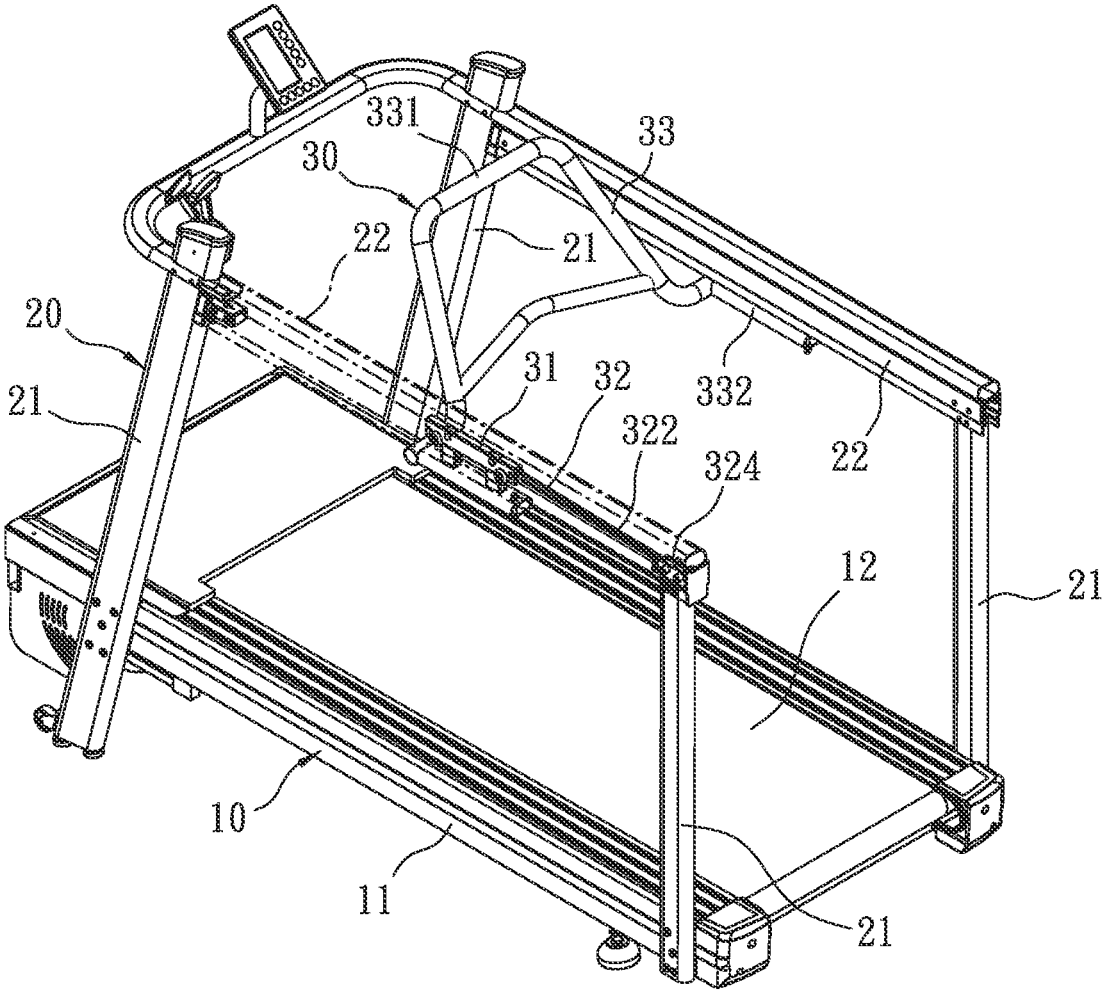
FIG. 10 is a perspective view showing the assembly of a part of a treadmill according to a third embodiment of the present invention.
Figure 11:
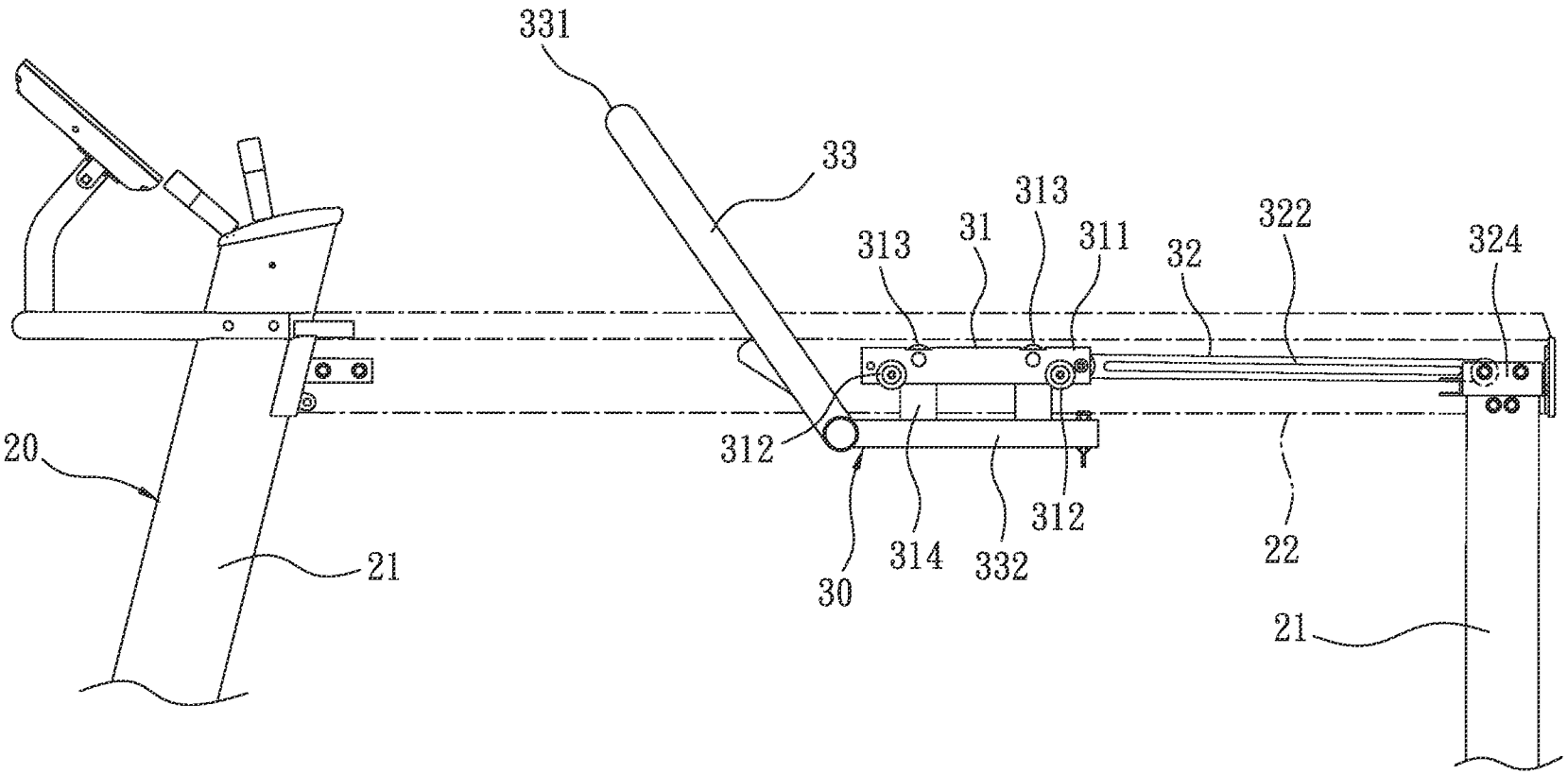
FIG. 11 is a side plan view showing the assembly of the treadmill according to the third embodiment of the present invention.

Referring to FIGS. 10 and 11, a difference of a treadmill of a third embodiment from that of the first embodiment includes one of two limitation structures 32 including a resilient unit 322 and a second fixing unit 324, wherein the resilient unit 322 is a resilient band, the resilient unit 322 and the second fixing unit 324 of the respective limitation structure 32 are connected on the rear end of the slider 311 of the respective sliding device 31, the second fixing unit 324 is fixed on the rear end of the resilient unit 322, wherein a first end of the resilient unit 322 of the respective limitation structure 32 is connected with the slider 311 of the respective sliding device 31, and a second end of the resilient unit 322 of the respective limitation structure 32 is connected with the second fixing unit 324.

When the user runs on the circular running belt 12 of the body 10, the grip portion 331 of the force exerting element 33 is held by the user so as to run on the body 10 stably, and the force exerting element 33 is pushed forward by the user to actuate the slider 311 of the respective sliding device 31 to slide forward in the slidable space 221, the resilient unit 322 of the respective limitation structure 32 stops the force exerting element 33 and the slider 311 of the respective sliding device 31 sliding forward, thus running on a predetermined position of the body 10. In addition, the user exercises hands, for example, the user pushes a heavy object forward on the body to train core muscles.

Figure 12:
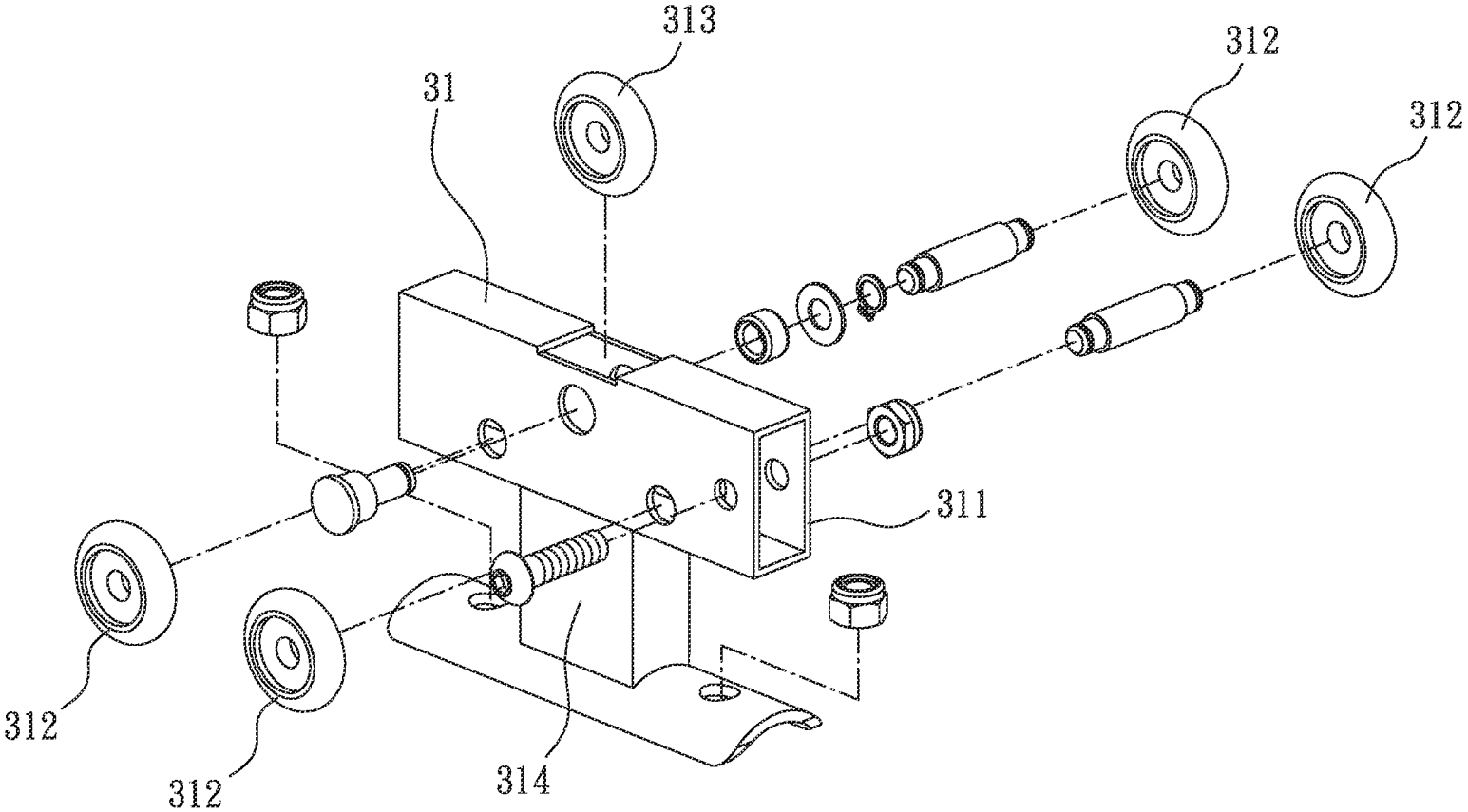
FIG. 12 is a perspective view showing the exploded components of a sliding device of a treadmill according to a fourth embodiment of the present invention.

As illustrated in FIG. 12, a difference of a treadmill of a fourth embodiment from that of the first embodiment comprises: the respective sliding device 31 including a second roller 313 rotatably connected with a top of the slider 311.

While various embodiments in accordance with the present invention have been shown and described, it is clear to those skilled in the art that further embodiments may be made without departing from the scope of the present invention.

What is claimed is:

1. A treadmill comprising:

a body including a holder and a circular running belt rotatably surrounding around the holder;

a support assembly connected on the holder of the body, the support assembly including multiple posts and two columns, the multiple posts extending upward from two sides of the body, the two columns being connected on the multiple posts of the two sides of the body so that the two columns are parallelly mounted above the two sides of the body, wherein each column of the two columns has a slidable space defined therein, and each slidable space of each of the two columns has two first chutes, one on each of two sides of the slidable space of each of the two columns;

a resistance unit fixed on the support assembly, and the resistance unit including two sliding devices, two limitation structures, and a force exerting element;

wherein each sliding device of the two sliding devices has a slider, at least one first roller rotatably connected on each of two sides of the slider, wherein the slider of the respective sliding device is slidably accommodated in the slidable space of the respective column of the support assembly, the respective at least one first roller rotatably connected on each of two sides of the slider is slidably received in the respective first chute of the slidable space, such that the slider of each of the two sliding device slides linearly in the slidable space of each column of the two columns, wherein each of the two sliding devices further has a coupling portion extending out of the slidable space;

two limitation structures, each limitation structure of the two limitation structures being accommodated in the slidable space of each column of the two columns of the support assembly and being connected with the slider of each sliding device of the two sliding devices so that the slider of each sliding device of the two sliding devices is stopped and limited in the slidable space of each column of the two columns, when sliding, wherein each limitation structure of the two limitation structures includes two cylinder units, a resilient unit, a first fixing unit, and a second fixing unit, wherein each cylinder unit of the two cylinder units and the first fixing unit of each limitation structure of the two limitations structures are disposed on a front end of the slider of each sliding device of the two sliding devices, the first fixing unit is mounted on a front end of each cylinder unit of the two cylinder units, wherein a first end of each cylinder unit of each limitation structure is connected with the slider of each sliding device of the two sliding devices, and a second end of each cylinder unit of each limitation structure is connected with the first fixing unit, the resilient unit and the second fixing unit of each limitation structure of the two limitation structures are fixed on a rear end of the slider of each sliding device of the two sliding devices, the second fixing unit is secured on a rear end of the resilient unit, wherein a first end of the resilient unit of each limitation structure of the two limitation structures is connected with the slider of each sliding device of the two sliding devices, and a second end of the resilient unit of each limitation structure of the two limitation structures is connected with the second fixing unit; and wherein the force exerting element has two connection rods connected on two ends thereof, and each of the two connection rods of the force exerting element is coupled with the coupling portion of one of the two sliding devices, such that a grip portion of the force exerting element is defined between the two columns of the support assembly, and the force exerting element actuates the slider of each sliding device of the two sliding devices to move.

2. The treadmill as claimed in claim 1, wherein the slidable space of each of the two columns of the support assembly has a second chute formed on a top of the slidable space, a top of the slider of each of the two sliding devices of the resistance unit is rotatably connected with at least one second roller, and the at least one second roller of the slider is slidably received in a second chute of the slidable space.

3. The treadmill as claimed in claim 1, further comprising a stop strap including two hook portions formed on two ends of the stop strap, wherein two retainers are connected with the two connection rods of the force exerting element, and each of the two hook portions of the stop strap is hooked with each of the two retainers of each of the two connection rods of the force exerting element, such that the stop strap is horizontally fixed between the two connection rods of the force exerting element.

4. The treadmill as claimed in claim 1, wherein each of the two cylinder units is a pneumatic cylinder or a hydraulic cylinder.

5. The treadmill as claimed in claim 1, wherein the resilient unit is a resilient band.

6. The treadmill as claimed in claim 1, wherein the force exerting element has a grip portion formed on a middle section thereof.

7. A treadmill comprising:

a body including a holder and a circular running belt rotatably surrounding around the holder;

a support assembly connected on the holder of the body, the support assembly including multiple posts and two columns, the multiple posts extending upward from two sides of the body, the two columns being connected on the multiple posts of the two sides of the body so that the two columns are parallelly mounted above the two sides of the body, wherein each column of the two columns has a slidable space defined therein, and each slidable space of each of the two columns has two first chutes, one on each of two sides of the slidable space of each of the two columns;

a resistance unit fixed on the support assembly, and the resistance unit including two sliding devices, two limitation structures, and a force exerting element;

wherein each sliding device of the two sliding devices has a slider, at least one first roller rotatably connected on each of two sides of the slider, wherein the slider of the respective sliding device is slidably accommodated in the slidable space of the respective column of the support assembly, the respective at least one first roller rotatably connected on each of two sides of the slider is slidably received in the respective first chute of the slidable space, such that the slider of each of the two sliding device slides linearly in the slidable space of each column of the two columns, wherein each of the two sliding devices further has a coupling portion extending out of the slidable space;

two limitation structures, each limitation structure of the two limitation structures being accommodated in the slidable space of each column of the two columns of the support assembly and being connected with the slider of each sliding device of the two sliding devices so that the slider of each sliding device of the two sliding devices is stopped and limited in the slidable space of each column of the two columns, when sliding, wherein each limitation structure of the two limitation structures includes two cylinder units and a first fixing unit, wherein each cylinder unit of the two cylinder units and the first fixing unit of each limitation structure of the two limitation structures are disposed on a front end of the slider of each sliding device of the two sliding devices, the first fixing unit is mounted on a front end of each cylinder unit of the two cylinder units, wherein a first end of each cylinder unit of each limitation structure is connected with the slider of each sliding device of the two sliding devices, and a second end of each cylinder unit of each limitation structure is connected with the first fixing unit; and wherein the force exerting element has two connection rods connected on two ends thereof, and each of the two connection rods of the force exerting element is coupled with the coupling portion of one of the two sliding devices, such that a grip portion of the force exerting element is defined between the two columns of the support assembly, and the force exerting element actuates the slider of each sliding device of the two sliding devices to move.

8. The treadmill as claimed in claim 7, wherein the slidable space of each of the two columns of the support assembly has a second chute formed on a top of the slidable space, a top of the slider of each of the two sliding devices of the resistance unit is rotatably connected with at least one second roller, and the at least one second roller of the slider is slidably received in a second chute of the slidable space.

9. The treadmill as claimed in claim 7, further comprising a stop strap including two hook portions formed on two ends of the stop strap, wherein two retainers are connected with the two connection rods of the force exerting element, and each of the two hook portions of the stop strap is hooked with each of the two retainers of each of the two connection rods of the force exerting element, such that the stop strap is horizontally fixed between the two connection rods of the force exerting element.

10. The treadmill as claimed in claim 7, wherein each of the two cylinder units is a pneumatic cylinder or a hydraulic cylinder.

11. The treadmill as claimed in claim 7, wherein the force exerting element has a grip portion formed on a middle section thereof.

12. A treadmill comprising:

a body including a holder and a circular running belt rotatably surrounding around the holder;

a support assembly connected on the holder of the body, the support assembly including multiple posts and two columns, the multiple posts extending upward from two sides of the body, the two columns being connected on the multiple posts of the two sides of the body so that the two columns are parallelly mounted above the two sides of the body, wherein each column of the two columns has a slidable space defined therein, and each slidable space of each of the two columns has two first chutes, one on each of two sides of the slidable space of each of the two columns;

a resistance unit fixed on the support assembly, and the resistance unit including two sliding devices, two limitation structures, and a force exerting element;

wherein each sliding device of the two sliding devices has a slider, at least one first roller rotatably connected on each of two sides of the slider, wherein the slider of the respective sliding device is slidably accommodated in the slidable space of the respective column of the support assembly, the respective at least one first roller rotatably connected on each of two sides of the slider is slidably received in the respective first chute of the slidable space, such that the slider of each of the two sliding device slides linearly in the slidable space of each column of the two columns, wherein each of the two sliding devices further has a coupling portion extending out of the slidable space;

two limitation structures, each limitation structure of the two limitation structures being accommodated in the slidable space of each column of the two columns of the support assembly and being connected with the slider of each sliding device of the two sliding devices so that the slider of each sliding device of the two sliding devices is stopped and limited in the slidable space of each column of the two columns, when sliding, wherein each limitation structure of the two limitation structures includes a resilient unit and a second fixing unit of each cylinder unit of the limitation structure of the two limitations structures are fixed on a rear end of the slider of each sliding device of the two sliding devices, and the second fixing unit is disposed on a rear end of the resilient unit, wherein a first end of the respective resilient unit of each limitation structure of the two limitation structures is connected with the slider of each sliding device of the two sliding devices, and a second end of the resilient unit of each limitation structure of the two limitation structures is connected with the second fixing unit; and wherein the force exerting element has two connection rods connected on two ends thereof, and each of the two connection rods of the force exerting element is coupled with the coupling portion of one of the two sliding devices, such that a grip portion of the force exerting element is defined between the two columns of the support assembly, and the force exerting element actuates the slider of each sliding device of the two sliding devices to move.

13. The treadmill as claimed in claim 12, wherein the slidable space of each of the two columns of the support assembly has a second chute formed on a top of the slidable space, a top of the slider of each of the two sliding devices of the resistance unit is rotatably connected with at least one second roller, and the at least one second roller of the slider is slidably received in a second chute of the slidable space.

14. The treadmill as claimed in claim 12, further comprising a stop strap including two hook portions formed on two ends of the stop strap, wherein two retainers are connected with the two connection rods of the force exerting element, and each of the two hook portions of the stop strap is hooked with each of the two retainers of each of the two connection rods of the force exerting element, such that the stop strap is horizontally fixed between the two connection rods of the force exerting element.

15. The treadmill as claimed in claim 12, wherein the resilient unit is a resilient band.

16. The treadmill as claimed in claim 12, wherein the force exerting element has a grip portion formed on a middle section thereof.

* * * * *